US006511340B1

(12) United States Patent
Lopez

(10) Patent No.: US 6,511,340 B1
(45) Date of Patent: Jan. 28, 2003

(54) DEVICE FOR MOUNTING ELECTRIC CONNECTORS FOR VEHICLES

(75) Inventor: Ramon Piñana Lopez, Valls (ES)

(73) Assignee: Lear Automotive (EEDS) Spain, S.L., Valls (ES)

( * ) Notice: Subject to any disclaimer, the term of this patent is extended or adjusted under 35 U.S.C. 154(b) by 363 days.

(21) Appl. No.: 10/049,114

(22) PCT Filed: Aug. 10, 2000

(86) PCT No.: PCT/ES00/00319

§ 371 (c)(1),
(2), (4) Date: Apr. 26, 2002

(87) PCT Pub. No.: WO01/11729

PCT Pub. Date: Feb. 15, 2001

(30) Foreign Application Priority Data

Aug. 10, 1999 (ES) ..... 9901846

(51) Int. Cl.[7] ..... H01R 13/127
(52) U.S. Cl. ..... 439/364; 439/489
(58) Field of Search ..... 439/364, 489

(56) References Cited

U.S. PATENT DOCUMENTS 5,228,867 A * 7/1993 Nagamine ..... 439/489
5,336,104 A * 8/1994 Nagamine ..... 439/489
5,419,714 A * 5/1995 Nagamine ..... 439/489
5,486,119 A * 1/1996 Nabeshima et al. ..... 439/489
5,490,799 A * 2/1996 Yamamoto ..... 439/489
5,601,450 A * 2/1997 Nabeshima et al. ..... 439/489
5,813,880 A 9/1998 Kodama
5,820,405 A * 10/1998 Yagi et al. ..... 439/489
5,836,787 A 11/1998 Kodama

FOREIGN PATENT DOCUMENTS

EP 920087 6/1999

* cited by examiner

*Primary Examiner*—Gary F. Paumen
(74) *Attorney, Agent, or Firm*—Sughrue Mion, PLLC

(57) ABSTRACT

An electrical connector mounting device, comprising a connector box (1) with cavities (2) for housing electrical connectors (3) coupled on a support (4) fixed to the vehicle, which includes cavities (5) that coincide with the cavities (2). The box (1) incorporates screws (7) arranged in the box (1). It includes means for detecting the coupling of the connector (3) in the box (1) which consist of a casing (9) which surrounds the screw (7) and slides with respect to the same when it is turned, so that its upper end (17) projects from the box (1), indicating that the connector (3) has been coupled in the box (1).

4 Claims, 1 Drawing Sheet

DEVICE FOR MOUNTING ELECTRIC CONNECTORS FOR VEHICLES

This application is a 371 of PCT/ES00/00319 filed Aug. 10, 2000. The disclosure of which is incorporated herein by reference.

The present Patent of Invention application consists, as its title indicates, of a "AN ELECTRICAL CONNECTOR MOUNTING DEVICE FOR VEHICLES", whose new characteristics of construction, shape and design fulfil the function for which it has specifically been designed, with maximum safety and effectiveness, and which provides many advantages, as described in the present specification.

In the field of connections for the different electrical devices, for example, of a car, mounting the connectors which form part of the electrical system of a vehicle in a connector box fixed to the chassis of the same is known.

The connectors are mounted one by one in the connector box and then the box is fixed to the vehicle's chassis. The main drawback arising from the use of said system of mounting the electrical connectors in vehicles is that the installation space of the connector box is usually small. Apart from the little space available, the operator who has to install the connector box finds that handling the same is complicated as the great number of connectors makes mounting and fixing of the same enormously difficult.

The U.S. Pat. No. 5,836,787, "Connector Assembly with Connector Housing Retaining Structure", applied for by Shinji Kodama, describes a connector housing attached to an electrical instrument, and a second connector housing disposed on a part of a panel wall, being both connector housings connected together by screw joining means. When the connectors connect together, the second connector housing can part from the panel wall toward the first connector housing and when the connectors separate from each other, the second connector housing can be provisionally retained on the panel wall by the provisionally retaining means.

The present device modifies the previous state of the art mentioned above and includes, among other elements, means for detecting the coupling of each connector in the connector box, which allows the operator to be notified that the connectors are connected in the box, or to determine whether there is any connector which has not been correctly coupled in the connector box The mounting device of the invention consists in a support which is adequately fixed to the vehicle's chassis and to which said connector box is coupled. This support is provided with cavities inside, which coincide with the cavities of the connector box, which are made for placing said electrical connectors. Prior placing of the connectors in these cavities of said support allows them to be conveniently distributed in correspondence with the cavities of the connector box.

Moreover, the connector box is advantageously provided with coupling means of the connectors in the connector box which allow these connectors to be extracted from the cavities of the support when the connector box is coupled to the support.

It should be emphasised that the arrangement of this support fixed to the vehicle is advantageous for the objects of the invention since, when the connector box is installed in the vehicle, the connectors have previously been adequately placed and distributed in the support ready for connection. The arrangement of the connectors in the support is easy, since they are arranged on top of the support. Therefore, mounting is very simple and enables costs to be reduced with respect to other known types of mounting for connectors.

In accordance with the invention, said coupling means of the connectors in the connector box consist of at least one screw provided in the connector box, which can be introduced by threading into an orifice of the connector. Turning said screw, extracts the connector from the cavity of the support and couples it with the connector box.

Once the support is fixed, the connector box is arranged on the same and said screws are turned, which forces the connectors to couple in the corresponding cavity of the connector box. Thus, it may be observed that installation of the box is very simple, since it is not necessary to handle it because the connectors are already correctly placed in their definitive mounting positions ready for connection.

In accordance with another aspect of the invention, the device also includes means for detecting the coupling of each connector in the connector box, which allows the operator to be notified that the connectors are connected in the box, or to determine whether there is any connector which has not been correctly coupled in the connector box. Said means for detecting the coupling of each connector in the connector box consist of a casing mounted around the outside of the screw of the coupling means described above. This casing can slide axially with respect to said screw in such a way that, when the screw is introduced into the orifice of the connector, said casing is forced to slide upwards in such a way that its upper end projects from the connector box, indicating to the operator that the connector has been coupled.

Preferably, the cavities of the support are provided with an upper rim which projects towards the inside of the cavity, which serves to prevent vertical movement of the connector when the box is not coupled in the support. This rim has a surface which is inclined outwards which serves to facilitate introduction of the connector. Moreover, each connector is provided with side tongues whose ends are arrow-shaped which couple under the upper rim of each cavity of the support. Said tongues consist of a rib inclined inwards which makes the tongue bend inwards when the inner wall of the cavity of the connector box makes contact with the rib. This allows the connector to be extracted from the cavity of the support and coupled to the connector box, as described above.

The features and advantages of the electrical connector mounting device for vehicles which is the object of the present invention, will be clear from the detailed description of a preferred embodiment of the same which will be given, from here on, by way of non-restrictive example. Said description refers to the accompanying drawings, in which.

Figures 1, 2, 3, 4:
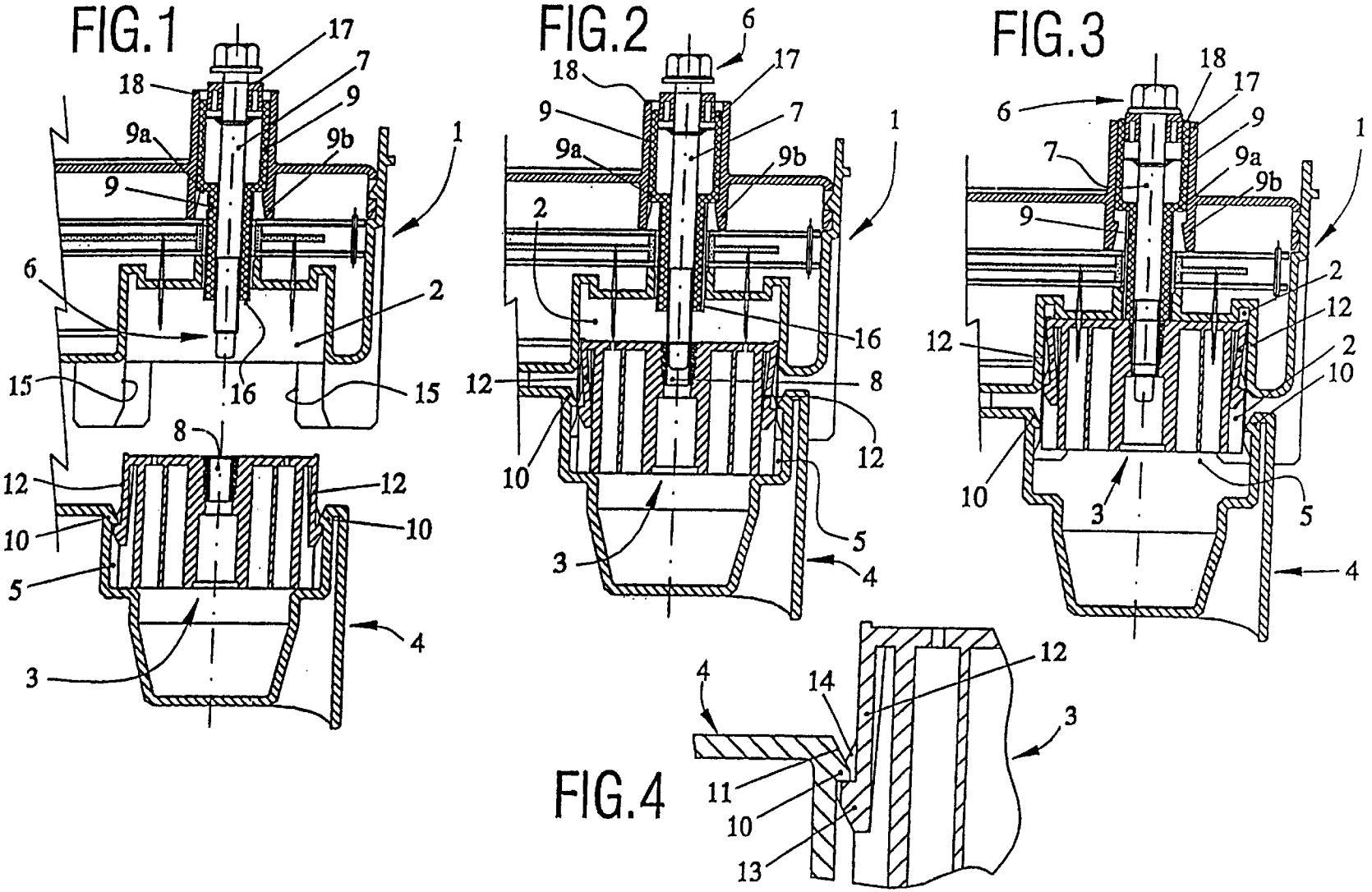
FIG. 1 is a partial cross-sectioned elevation view of the electrical connector mounting device for vehicles of the invention, in which the connector box separated from the support is represented.
FIG. 2 is a partial cross-sectioned elevation view of the device of the invention, in which the connector box is represented partially coupled to the support.
FIG. 3 is a partial cross-sectioned elevation view of the device of the invention, which shows the connector box completely coupled to the support, and in which the connector is shown perfectly connected in the connector box.
FIG. 4 is an enlarged partial view in accordance with the connector mounting device arranged in the position represented in FIG. 1.

The elements described in the figures correspond to (1) connector box, (2) cavities of the connector box, (3) electrical connector, (4) support, (5) cavities of the support, (6) coupling means, (7) screw, (8) connector orifice, (9) casing, **(9*a*) upper widened area of the casing, (9*b*) inner projections of the connector box, (10) upper rim of the support cavities, (11) inclined surface of the rim, (12) side tongues, (13) tongue ends, (14) tongue ribs, (15) walls of the cavities of the box, (16) lower part of the casing, (17) upper end of the casing and (18**) upper part of the connector box.

With reference to FIGS. 1 to 3, the electrical connector mounting device for vehicles is made up of a connector box (1) provided with cavities (2) to house electrical connectors (3) inside, and a support (4) fixed to the chassis of the vehicle upon which the connector box (1) is coupled. The support (4) is provided with cavities (5) inside, which coincide with the cavities (2) of the connector box (1) mentioned above. These cavities (5) are also adapted to house the electrical connector (3), as may clearly be observed in FIG. 1.

The support (4) includes coupling means (6) of each connector (3) in the connector box (1) which, in the embodiment of the drawings, consists of a series of screws (7) of which, for reasons of clarity, only one is represented in the drawings. The screw (7) is provided in the connector box (1) and may be threaded into an orifice (8) of the connector (3) to cause the connector (3) to be extracted, as we will specify below.

The device of the invention is also equipped with means to detect the coupling of each connector (3) in the connector box (1), which consist of a casing (9) mounted around the outside of the screw (7) in such a way that it may slide axially with respect to the same.

It may be observed in the drawings that the casing has a widened upper area (9*a*) which serves as a check against inner projections (9*b*) of the box (1) to limit the path of the casing (9). Thus, in FIGS. 1 and 2, the lower part of said widened area (9*a*) is in contact with the inner projections (9*b*) as the connector (3) is not coupled in the box (1).

As may be observed in the drawings, the cavities (5) of the support (4) have an upper rim (10) which projects towards the inside of the cavity (5), which may be observed in FIG. 4. This rim (10) serves to prevent vertical movement of the connector (3) when the box (1) is not coupled in the support (4). With reference again to FIG. 4, the rim (10) has a surface (11) inclined outwards which serves to facilitate introduction of the connector (3). In this sense, each connector (3) is provided with side tongues (12) whose ends (13) are arrow-shaped and which couple under the upper rim (10) of each cavity (5) of the support (4) as shown in FIG. 4, in which it may also be observed that said tongues (12) are provided with a rib (14) inclined inwards which causes the tongue (12) to bend inwards (see the position in FIG. 2) in order to make it possible to extract the connector (3) from the cavity (5) of the support (4).

As the connector box (1) descends upon the support (4), the inner walls (16) of the cavity (2) of said box (1) slide over the inclined surface of the rib (14) causing the tongue (12) to bend inwards (FIG. 2), thus allowing the connector (3) to be extracted from the cavity (5) of the support (4).

The connectors (3) are mounted on the device of the invention in the following way:

Firstly, the support (4) is fixed to the vehicle's chassis and then the electrical connectors (3) are placed in the corresponding cavities (5) of the support (4), as shown in FIG. 1, in such a way that the ends (13) of the tongues (12) are perfectly introduced under the upper rim (10) of the cavity (5).

Next, the connector box (1) is placed upon the support (FIG. 1) and coupled with the same, as shown in FIG. 2, so that the cavities (2, 5) coincide perfectly.

As the connector box (1) descends upon the support (4), the inner walls (15) of the cavity (2) of said box (1) slide over the inclined surface of the rib (14) causing the tongue (12) to bend inwards (FIG. 2), thus allowing the connector (3) to be extracted from the cavity (5) of the support (4).

Next, the screw (7) is turned in the orifice (9) of the connector (3) so that the connector (3) leaves the cavity (5), ascends towards the cavity (2) and couples correctly in the connector box (1), as illustrated in FIG. 3.

As the electrical connector (3) moves upwards to couple in the connector box (1), it pushes the casing (9) by its lower part (16). In the connection position, which is represented in FIG. 3, in which the connector (3) is completely coupled in the connector box (1), housed in the cavity (2), the upper end (17) of the casing (9) slightly projects from the upper part (18) of the box (1) where the screw (7) is housed. It is intended that the casing (9) be made of plastic material and given a striking colour (for example, red) so that said projecting upper end (17) of the same may easily be perceived by the operator who is mounting the connectors (3) with the mounting device which is the object of the present invention.

When the end (17) of the casing (9) projects from the upper part (18) of the box (1), the operator can be sure that the connector (3) is perfectly connected in said box (1). Therefore, the device of the invention ensures the connection between the connectors (3) and the connector box (1) thanks to the elements described above.

Having sufficiently described what the present invention consists of, with reference to the attached drawings, it will be understood that any modification of detail considered convenient can be introduced into the same, provided that the essential nature of the invention is not altered, which is summarised in the following ClAIMS.

What is claimed is:

1. "AN ELECTRICAL CONNECTOR MOUNTING DEVICE FOR VEHICLES", which consists of a connector box (1) provided with a plurality of cavities (2) for housing electrical connectors (3) inside, comprising a support (4) fixed to the chassis of a vehicle on which the connector box (1) is coupled; said support (4) being provided inside with cavities (5) which coincide with the cavities (2) of the connector box (1), which are made for placing said electrical connectors (3) in such a way that they are distributed in correspondence with the cavities (2) of the connector box (1); said connector box (1) is provided with one screw (7) arranged in the box (1) for threading into an orifice (8) of the connector (3) so that when the screw (7) is turned, the connector (3) is extracted from the cavity (5) of the support (4) and coupled in the connector box (1) of the connectors (3), when the box (1) is coupled in the support (4) characterised in that it includes means for detecting the coupling of each connector (3) in the connector box (1), comprising said means a casing (9) mounted around the outside of the screw (7) of the coupling means (6), which can slide axially with respect to said screw (7) in such a way that, when the screw (7) is introduced into the orifice (8) of the connector (3), said casing (9) is forced to slide axially upwards and its upper end (17) projects from the connector box (1), indicating that the connector (3) has been coupled in the box (1).

2. "AN ELECTRICAL CONNECTOR MOUNTING DEVICE FOR VEHICLES" in accordance with claim 1, characterised in that the cavities (5) of the support (4) are provided with an upper rim (10) which projects towards the inside of the cavity (5) in order to prevent vertical movement of the connector (3) when the box (1) is not coupled in the support (4); said rim (10) having a surface inclined (11) outwards which serves to facilitate introduction of the connector (3).

3. "AN ELECTRICAL CONNECTOR MOUNTING DEVICE FOR VEHICLES" in accordance with claim 1, characterised in that each connector (3) is provided with side tongues (12) whose ends (13) are arrow-shaped for coupling under the upper rim (10) of each cavity (5) of the support (4); said tongues (12) comprising a rib (14) inclined inwards which causes the tongue (12) to bend inwards when the inner walls (15) of the cavity (2) of the connector box (1) make contact with said rib (14), thus allowing the connector (3) to be extracted from the cavity (5) of the support (4) and coupled to the connector box (1).

4. "AN ELECTRICAL CONNECTOR MOUNTING DEVICE FOR VEHICLES" in accordance with claim 2, characterised in that each connector (3) is provided with side tongues (12) whose ends (13) are arrow-shaped for coupling under the upper rim (10) of each cavity (5) of the support (4); said tongues (12) comprising a rib (14) inclined inwards which causes the tongue (12) to bend inwards when the inner walls (15) of the cavity (2) of the connector box (1) make contact with said rib (14), thus allowing the connector (3) to be extracted from the cavity (5) of the support (4) and coupled to the connector box (1).

* * * * *